US012767394B2

(12) United States Patent
Cheng

(10) Patent No.: US 12,767,394 B2
(45) Date of Patent: Oct. 20, 2026

(54) WATER CUP

(71) Applicant: Zhejiang Navigate Industry & Trading Co., Ltd., Zhejiang (CN)

(72) Inventor: Pingjiang Cheng, Zhejiang (CN)

(73) Assignee: Zhejiang Navigate Industry & Trading Co., Ltd., Zhejiang (CN)

( * ) Notice: Subject to any disclaimer, the term of this patent is extended or adjusted under 35 U.S.C. 154(b) by 0 days.

(21) Appl. No.: 18/814,596

(22) Filed: Aug. 26, 2024

(65) Prior Publication Data

US 2026/0054889 A1 Feb. 26, 2026

(51) Int. Cl.
*B65D 43/02* (2006.01)
*A47G 19/22* (2006.01)

(52) U.S. Cl.
CPC ..... *B65D 43/0225* (2013.01); *A47G 19/2205* (2013.01)

(58) Field of Classification Search
CPC ..... B65D 43/0225; B65D 23/00; A47G 19/2205; A47G 19/22
See application file for complete search history.

(56) References Cited

U.S. PATENT DOCUMENTS

2021/0347532 A1* 11/2021 Wang ..... B65D 43/0225
2022/0081170 A1* 3/2022 Fraser ..... B65D 41/0442
2023/0303298 A1* 9/2023 Harris ..... B65D 43/0225
2024/0092544 A1* 3/2024 Huang ..... B65D 43/0225
2024/0109045 A1* 4/2024 Tonn ..... B01F 35/718051

FOREIGN PATENT DOCUMENTS

CN 220713597 4/2024

* cited by examiner

*Primary Examiner* — Ernesto A Grano
*Assistant Examiner* — Symren K Sanghera
(74) *Attorney, Agent, or Firm* — Hemisphere Law, PLLC

(57) ABSTRACT

The present disclosure provides a square water cup, including a cup cover assembly and a cup body; the water cup of the present application further meets requirements of a user by achieving stable connection between the cup cover and a rectangular cup mouth; and matching between a limiting groove in a sealing cover and a limiting member of a lower cover of the present application achieves limitation on a rotation range of the cup cover, and further ensures the safety in use; meanwhile, simple structural design also facilitates the use and assembly of the product; and the square water cup of the present application can further improve the use experience and safety protection for the user.

6 Claims, 6 Drawing Sheets

WATER CUP

TECHNICAL FIELD

The present application relates to the technical field of water cups, and more particularly relates to a water cup.

BACKGROUND ART

At present, water cups are indispensable drinking utensils in people's daily life. In order to meet the requirements of various users, the manufacturer creates a water cup in the design of a water cup style.

Generally, in conventional water cups, cup covers and cup bodies are often opened and closed by means of threaded connection, and the like, and meanwhile cup mouths are mostly circular. Meanwhile, considering production and manufacturing processes and other aspects, circular liners are usually adopted to be mounted in square cup bodies, so that volumes of the cups are wasted, and opening and closing forms of square cup mouths have not yet been achieved.

In the prior art, granted publication No.: CN220713597U, entitled Square Water Cup, includes a cup body and a cup cover disposed on the cup body, wherein the cup cover is threadedly connected to the cup body. The present application has the effects of ensuring that a side wall of the cup cover and a side wall of the cup body are in a flush state after the cup cover is rotated and tightened on the cup body, improving the aesthetic degree of the water cup, and facilitating carrying and storage.

In view of the problems existing in the prior art, there is an urgent need for a way to achieve the opening and closing of the square cup mouth, so as to further meet the requirements of relevant users.

SUMMARY OF THE INVENTION

In order to solve the problems existing in the prior art, the present disclosure provides a water cup. The water cup of the present application further meets requirements of a user by achieving stable connection between the cup cover and a rectangular cup mouth; and matching between a limiting groove in a sealing cover and a limiting member of a lower cover of the present application achieves limitation on a rotation range of the cup cover, and further ensures the safety in use; meanwhile, simple structural design also facilitates the use and assembly of the product; and the water cup of the present application can further improve the use experience and safety protection for the user.

In order to achieve the above object, the present disclosure provides a water cup, including a cup cover assembly and a cup body;

wherein the cup body is provided with a rectangular cup mouth;

the cup cover assembly can be covered at the cup mouth, the cup cover assembly includes an upper cover and a lower cover, the upper cover is connected to the lower cover, the lower cover rotates together with the upper cover, and the upper cover and the lower cover rotate relative to the cup body; and the lower cover or an inner wall of the cup body is provided with at least one limiting member, the limiting member is disposed between the lower cover and the inner wall of the cup body, and the inner wall of the cup body or the lower cover is provided with at least one buckle, the buckle is disposed between the lower cover and the inner wall of the cup body, the limiting member rotates along with the cup cover assembly to be disposed and clamped on the buckle, and the limiting member is used for limiting the cup cover assembly.

The water cup of the present application achieves an opening and closing manner of the cup body and the cup cover by the matching between the buckle and the limiting member, thereby further ensuring the safety in use.

Preferably, the upper cover and the lower cover are threadedly connected, or the upper cover and the lower cover are fixedly connected.

Preferably, one end of the limiting member is disposed as an upwardly inclined surface, a blocking plate is connected to one end, the blocking plate is positioned between the limiting member and the upper cover, and the blocking plate is used for limiting the buckle; and the buckle is disposed on the upwardly inclined surface disposed at one end of the limiting member, and one end of the upper cover rotates along with the cup cover assembly to be downwardly adhered to the cup mouth.

Preferably, the cup cover assembly further includes a sealing cover, the sealing cover is mounted on the lower cover, the sealing cover is positioned between the upper cover and the lower cover, the sealing cover can be disposed in the cup mouth, and the sealing cover does not rotate along with the cup cover assembly.

Preferably, the cup cover assembly further includes a fixing ring, and the fixing ring is positioned between the sealing cover and the upper cover;

the sealing cover is provided with a mounting groove, and the fixing ring is mounted on the sealing cover through the mounting groove; and one end of the lower cover passes through the sealing cover to be threadedly connected to the fixing ring.

Preferably, the sealing cover is provided with at least one rotation limiting groove, and the rotation limiting groove is positioned between the lower cover and the sealing cover;

the lower cover is provided with at least one rotation limiting member, the rotation limiting member is mounted in the rotation limiting groove, and the rotation limiting groove is used for limiting a rotation angle of the cup cover assembly.

Preferably, the upper cover is further provided with a lifting handle.

Preferably, a body of the cup body has an inner-outer two-layer structure.

Compared with the prior art, the present disclosure has the following beneficial effects.

The present disclosure provides a water cup, and the water cup of the present application can solve the defect that the opening and closing manner of the rectangular cup mouth cannot be achieved by the existing water cup. The rotary opening and closing of the cup cover assembly and the cup body is achieved by the matching between the buckle and the limiting member, and meanwhile, the water cup is applicable to the mounting which is not merely limited to the rectangular cup mouth, thereby further ensuring the use experience; and The rotation of the cup cover assembly is limited by the matching between the rotation limiting groove and the rotation limiting member mounted in the rotation limiting groove, thereby preventing the product from being opened accidentally in accidental scenes such as falling, and further ensuring the safety in use.

BRIEF DESCRIPTION OF THE DRAWINGS

In order to explain technical solutions in specific embodiments of the present disclosure or the prior art more clearly, a brief introduction will be given to accompanying drawings to be used in the description of the specific embodiments or the prior art below. It is obvious that the accompanying drawings in the description below are intended for some embodiments of the present disclosure, and other accompanying drawings may also be obtained by those ordinarily skilled in the art without involving any inventive effort.

Figure 1:
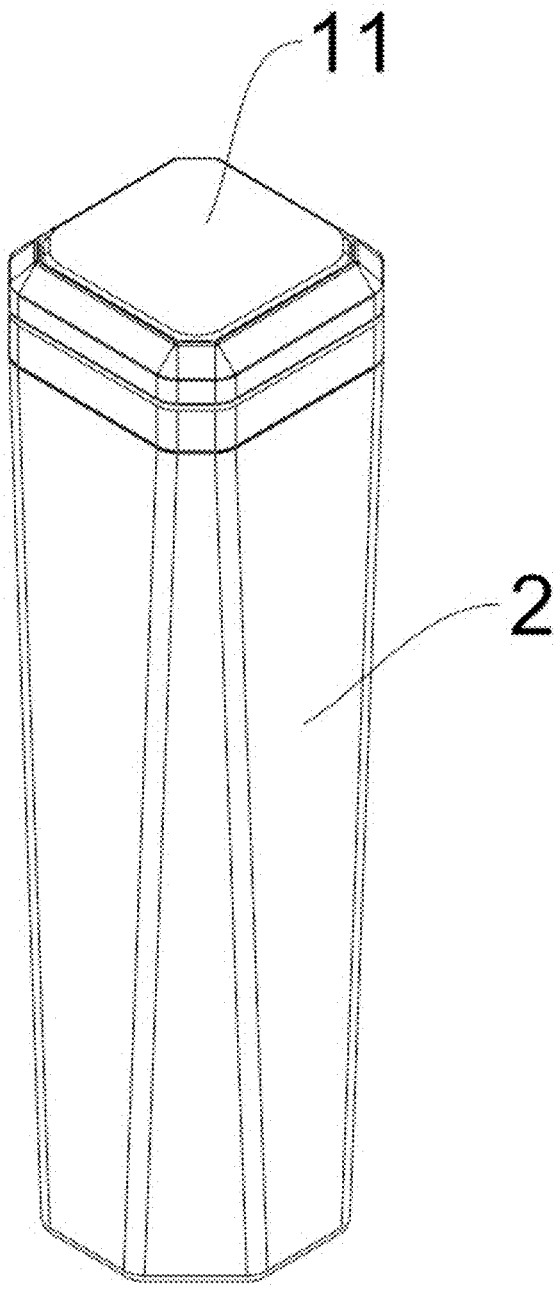
FIG. 1 is a schematic diagram of a stereoscopic structure of a water cup according to the present disclosure.

As shown in the drawings: cup cover assembly 1, upper cover 11, lower cover 12, rotation limiting member 121, sealing cover 13, rotation limiting groove 131, fixing ring 14, cup body 2, limiting member 3, inclined surface 31, blocking plate 32, and buckle 4.

DETAILED DESCRIPTION OF THE INVENTION

In order that the objects, technical solutions, and advantages of examples of the present disclosure will become clearer, a clear and complete description of the technical solutions in the examples of the present disclosure will be rendered with reference to the accompanying drawings in the examples of the present disclosure. It is obvious that the examples described are only some, but not all, of the examples of the present disclosure. Generally, components of the examples of the present disclosure described and illustrated in the accompanying drawings herein may be arranged and designed in various different configurations. Therefore, the following detailed description of the examples of the present disclosure provided in the accompanying drawings is not intended to limit the scope of the present disclosure as claimed, but is merely representative of selected examples of the present disclosure. Based on the examples in the present disclosure, all other examples obtained by those ordinarily skilled in the art without involving any inventive effort shall fall within the scope of protection of the present disclosure.

Example 1

Figure 2:
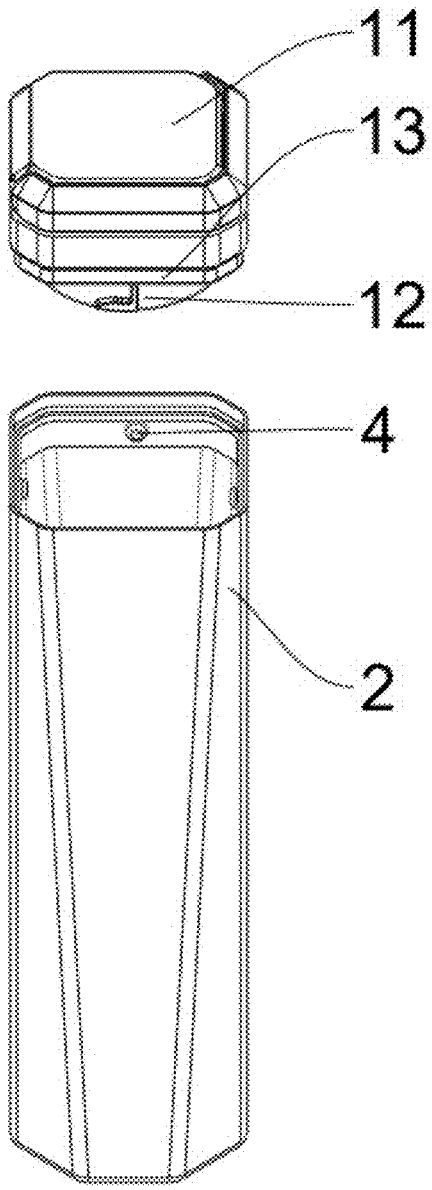
FIG. 2 is an exploded stereogram of the water cup according to the present disclosure.
Figure 3:
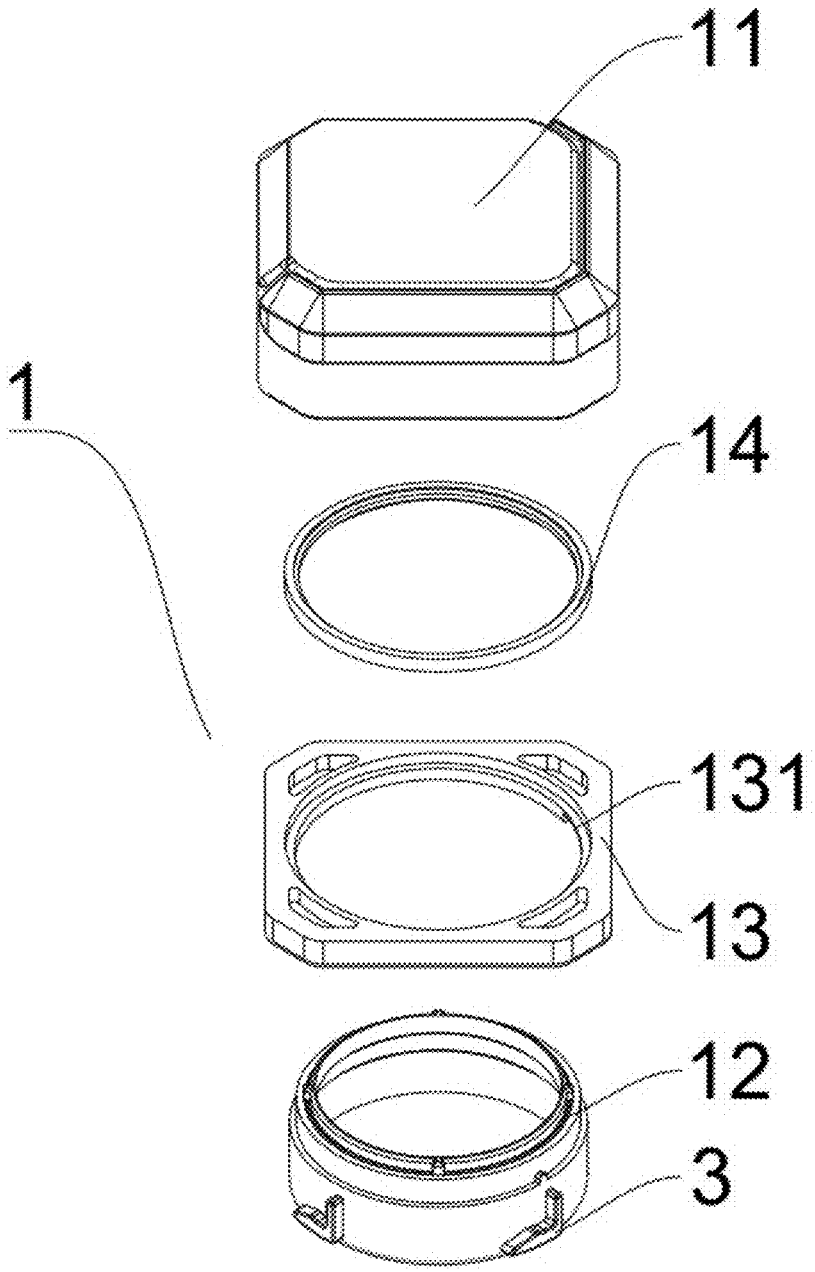
FIG. 3 is an exploded stereogram of a cup cover assembly of the water cup according to the present disclosure.
Figure 4:
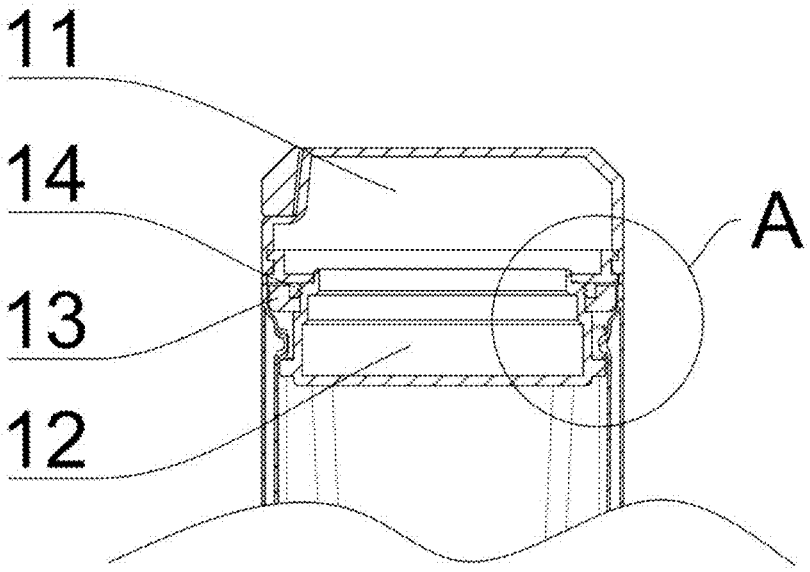
FIG. 4 is a partial cross-sectional diagram of the water cup according to the present disclosure.
Figure 5:
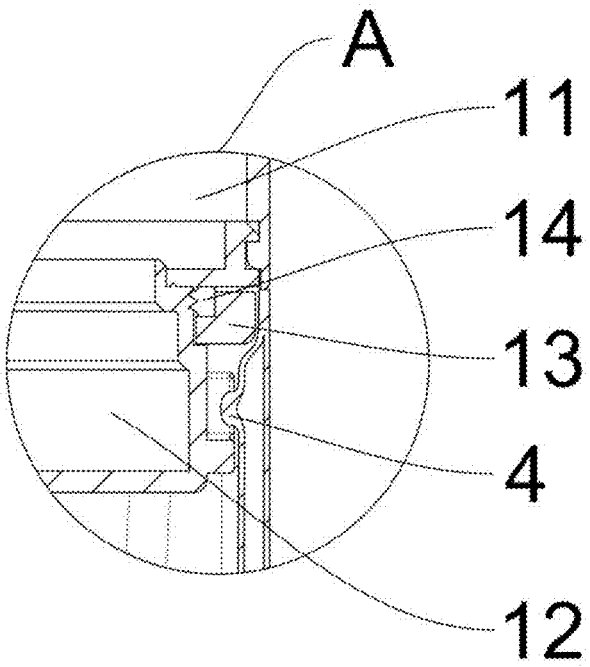
FIG. 5 is an enlarged diagram of a portion A in FIG. 2.
Figure 6:
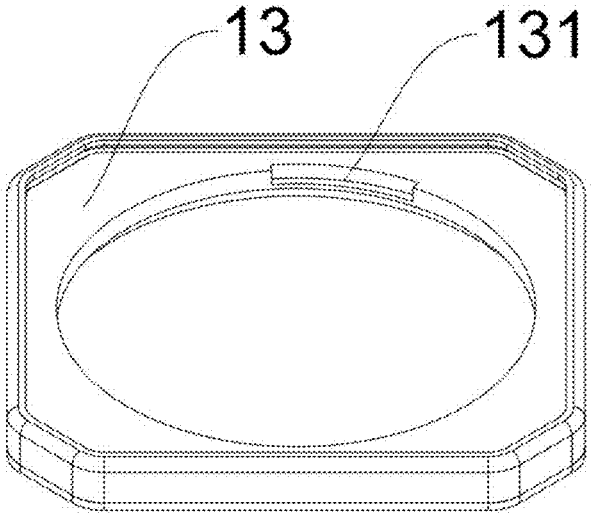
FIG. 6 is a stereogram of a sealing ring of the cup cover assembly of the water cup according to the present disclosure.
Figure 7:
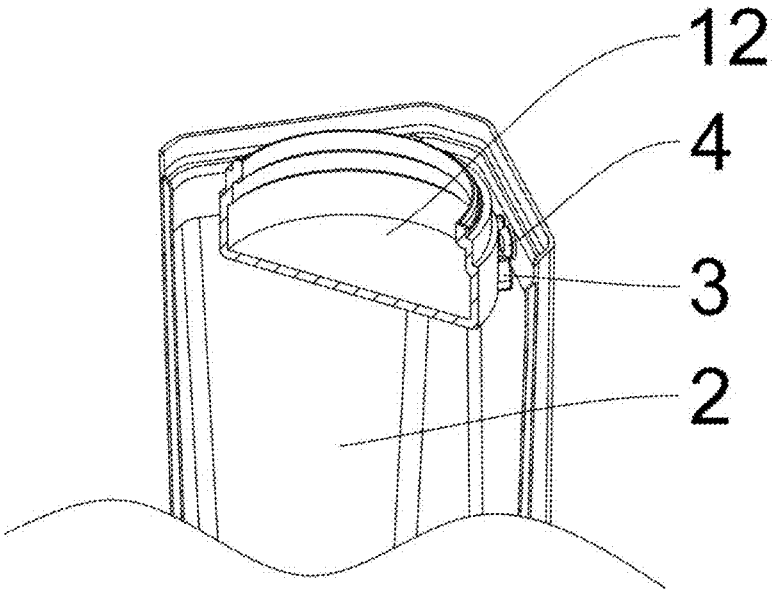
FIG. 7 is a diagram illustrating a mounting condition of a limiting member and a buckle of the water cup according to the present disclosure.
Figure 8:
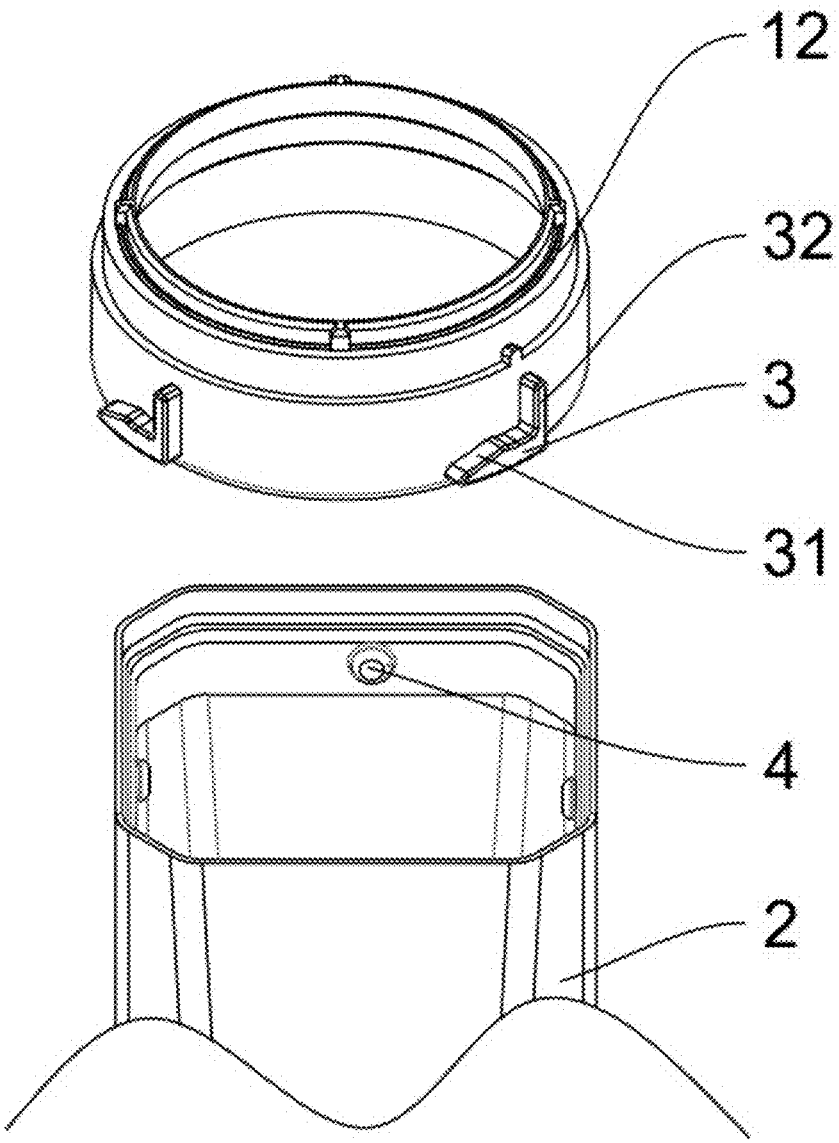
FIG. 8 is a partial stereogram of a lower cover and a cup body of the water cup according to the present disclosure.

As shown in FIG. 1 to FIG. 6, this example provides a water cup, including a cup cover assembly 1 and a cup body 2;

wherein the cup body 2 is provided with a rectangular cup mouth;

the cup cover assembly 1 can be covered at the cup mouth, the cup cover assembly 1 includes an upper cover 11 and a lower cover 12, the upper cover 11 is connected to the lower cover 12, the lower cover 12 rotates together with the upper cover 11, and the upper cover 11 and the lower cover 12 rotate relative to the cup body 2; and the lower cover 12 is provided with four limiting members 3, the limiting members 3 are disposed between the lower cover 12 and an inner wall of the cup body 2, and the inner wall of the cup body 2 is provided with four buckles 4, the buckles 4 are disposed between the lower cover 12 and the inner wall of the cup body 2, the limiting members 3 rotate along with the cup cover assembly 1 to be disposed and clamped on the buckles 4, and the limiting members 3 are used for limiting the cup cover assembly 1.

The upper cover 11 and the lower cover 12 are fixedly connected.

One end of the limiting member 3 is disposed as an upwardly inclined surface 31, a blocking plate 32 is connected to one end, the blocking plate is positioned between the limiting member 3 and the upper cover 11, and the blocking plate 32 is used for limiting the buckle 4; and the buckle 4 is disposed on the upwardly inclined surface 31 disposed at one end of the limiting member 3, and one end of the upper cover 11 rotates along with the cup cover assembly 1 to be downwardly adhered to the cup mouth.

The cup cover assembly 1 further includes a sealing cover 13, the sealing cover 13 is mounted on the lower cover 12, the sealing cover 13 is positioned between the upper cover 11 and the lower cover 12, the sealing cover 13 can be disposed in the cup mouth, and the sealing cover 13 does not rotate along with the cup cover assembly 1.

The cup cover assembly 1 further includes a fixing ring 14, and the fixing ring 14 is positioned between the sealing cover 13 and the upper cover 11;

the sealing cover 13 is provided with a mounting groove, and the fixing ring 14 is mounted on the sealing cover 13 through the mounting groove; and one end of the lower cover 12 passes through the sealing cover 13 to be threadedly connected to the fixing ring 14.

The sealing cover 13 is provided with one rotation limiting groove 131, and the rotation limiting groove 131 is positioned between the lower cover 12 and the sealing cover 13; and the lower cover 12 is provided with one rotation limiting member 121, the rotation limiting member 121 is mounted in the rotation limiting groove 131, and the rotation limiting groove 131 is used for limiting a rotation angle of the cup cover assembly 1.

The upper cover 11 is further provided with a lifting handle.

The upper cover 11 is in a square shape.

A body of the cup body 2 has an inner-outer two-layer structure.

The working principle of this example: in this example, the lower cover 12 passes through the sealing cover 13 to be threadedly connected to the fixing ring 14, meanwhile the rotation limiting member 121 is mounted in the rotation limiting groove 131, and then the upper cover 11 is threadedly connected to the lower cover 12, so as to complete the portable assembly of the cup cover assembly 1.

The cup cover assembly 1 is then placed into the cup body 2, meanwhile the sealing cover 13 is mounted in the cup mouth, then the cup cover assembly 1 is rotated, and the buckles 4 are clamped on the limiting members 3, so as to complete the convenient mounting. If it is necessary to use, the cup cover assembly 1 is rotated in a direction opposite to a mounting rotation direction, and then the cup cover assembly 1 is drawn out, so as to complete the portable mounting.

Example 2

As shown in FIG. 1 to FIG. 5, this example provides a water cup, including a cup cover assembly 1 and a cup body 2;

wherein the cup body 2 is provided with a rectangular cup mouth;

the cup cover assembly 1 can be covered at the cup mouth, the cup cover assembly 1 includes an upper cover 11 and a lower cover 12, the upper cover 11 is connected to the lower cover 12, the lower cover 12 rotates together with the upper cover 11, and the upper cover 11 and the lower cover 12 rotate relative to the cup body 2; and an inner wall of the cup body 2 is provided with four limiting members 3, the limiting members 3 are disposed between the lower cover 12 and the inner wall of the cup body 2, and the lower cover 12 is provided with four buckles 4, the buckles 4 are disposed between the lower cover 12 and the inner wall of the cup body 2, the buckles 4 rotate along with the cup cover assembly 1 to be disposed and clamped on the limiting members 3, and the limiting members 3 are used for limiting the cup cover assembly 1.

The upper cover 11 and the lower cover 12 are fixedly connected.

The working principle of this example: in this example, the upper cover 11 is then threadedly connected to the lower cover 12, so as to complete the portable assembly of the cup cover assembly 1.

The cup cover assembly 1 is then placed into the cup body 2, afterwards the cup cover assembly 1 is rotated, and the buckles 4 are clamped on the limiting members 3, so as to complete the convenient mounting. If it is necessary to use, the cup cover assembly 1 is rotated in a direction opposite to a mounting rotation direction, and then the cup cover assembly 1 is drawn out, so as to complete the portable mounting.

Of course, the foregoing is only specific examples of the present disclosure and is not to be construed as limiting the implementation scope of the present disclosure. Any equivalent changes or modifications made in accordance with the structures, features and principles in the scope of the present application shall be included in the scope of the patent application.

Finally, it should be noted that the above examples are merely specific embodiments of the present disclosure for illustrating the technical solutions of the present disclosure, rather than limiting the technical solutions, and the scope of protection of the present disclosure is not limited to this. Although the present disclosure has been described in detail with reference to the above examples, those ordinarily skilled in the art should understand that any one of those skilled in the art can still make modifications or readily think of changes to the technical solutions recited in the above examples, or replace some of the technical features with equivalent ones within the technical scope disclosed by the present disclosure; and these modifications, changes or replacements do not make the essence of the corresponding technical solutions depart from the spirit and scope of the technical solutions of the examples of the present disclosure, and all should be covered by the scope of protection of the present disclosure. Therefore, the scope of protection of the present disclosure should be determined by the scope of protection of the claims.

What is claimed is:

1. A water cup, comprising a cup cover assembly and a cup body, wherein the cup body is provided with a cup mouth, the cup cover assembly is configured to cover an opening of the cup mouth, the cup cover assembly comprises an upper cover and a lower cover, the upper cover is connected to the lower cover, the lower cover is configured to rotate together with the upper cover, and the upper cover and the lower cover are configured to rotate relative to the cup body, and the lower cover is provided with at least one limiting member, the limiting member is disposed between the lower cover and an inner wall of the cup body, and the inner wall of the cup body is provided with at least one buckle, the at least one buckle is disposed between the lower cover and the inner wall of the cup body, the limiting member is configured to rotate along with the cup cover assembly to be placed on the at least one buckle;

wherein the cup cover assembly further comprises a sealing cover, the sealing cover is mounted on the lower cover, the sealing cover is positioned between the upper cover and the lower cover, the sealing cover is disposed in the cup mouth, and the sealing cover is configured to not rotate when the rest of the cup cover assembly is rotating.

2. The water cup according to claim 1, wherein the upper cover and the lower cover are threadedly connected or the upper cover and the lower cover are fixedly connected.

3. The water cup according to claim 1, wherein one end of the limiting member is disposed as an inclined surface, a blocking plate is connected to one end, and when the at least one buckle is placed on the inclined surface disposed at one end of the limiting member, one end of the upper cover is downwardly adhered to the cup mouth.

4. The water cup according to claim 1, wherein the cup cover assembly further comprises a fixing ring, and the fixing ring is positioned between the sealing cover and the upper cover, the sealing cover is provided with a mounting groove, and the fixing ring is mounted on the sealing cover through the mounting groove, and one end of the lower cover passes through the sealing cover to be threadedly connected to the fixing ring.

5. The water cup according to claim 4, wherein the sealing cover is provided with at least one rotation limiting groove, and the rotation limiting groove is positioned between the lower cover and the sealing cover, and the lower cover is provided with at least one rotation limiting member, the rotation limiting member is mounted in the rotation limiting groove, and the rotation limiting groove is used for limiting a rotation angle of the cup cover assembly.

6. The water cup according to claim 1, wherein a body of the cup body has an inner-outer two-layer structure.

* * * * *